US007731159B2

(12) United States Patent
Amengual Pericas

(10) Patent No.: US 7,731,159 B2
(45) Date of Patent: Jun. 8, 2010

(54) CONTINUOUS METALLIC SYSTEM FOR SAFETY BARRIERS APPLICABLE AS PROTECTION FOR MOTORCYCLISTS MADE UP OF A BOTTOM CONTINUOUS HORIZONTAL METALLIC SCREEN SUPPORTED ON THE BARRIER BY MEANS OF METALLIC ARMS ARRANGED AT REGULAR INTERVALS

(75) Inventor: Antonio Amengual Pericas, Asturias (ES)

(73) Assignee: Hierros y Aplanaciones, S.A., Asturias (ES)

( * ) Notice: Subject to any disclaimer, the term of this patent is extended or adjusted under 35 U.S.C. 154(b) by 0 days.

(21) Appl. No.: 11/994,828

(22) PCT Filed: Jul. 5, 2006

(86) PCT No.: PCT/ES2006/000386

§ 371 (c)(1),
(2), (4) Date: Jan. 4, 2008

(87) PCT Pub. No.: WO2007/006827

PCT Pub. Date: Jan. 18, 2007

(65) Prior Publication Data

US 2009/0206308 A1 Aug. 20, 2009

(30) Foreign Application Priority Data

Jul. 6, 2005 (ES) ..... 200501560 U

(51) Int. Cl.
*E01F 15/00* (2006.01)
*E01C 11/22* (2006.01)

(52) U.S. Cl. ..... 256/13.1; 404/8

(58) Field of Classification Search ..... 256/13.1; 404/6–9

See application file for complete search history.

(56) References Cited

U.S. PATENT DOCUMENTS

| | | | | |
|---|---|---|---|---|
| 5,429,449 | A * | 7/1995 | Baatz | 404/6 |
| 7,172,362 | B2 * | 2/2007 | Schmitt | 404/6 |
| 7,257,875 | B2 * | 8/2007 | Masinelli et al. | 404/6 |
| 2004/0067105 | A1 * | 4/2004 | Goesel | 404/9 |
| 2005/0104054 | A1 * | 5/2005 | Humphries et al. | 256/13.1 |
| 2006/0159516 | A1 * | 7/2006 | Schmitt | 404/6 |
| 2008/0067484 | A1 * | 3/2008 | Amengual Pericas | 256/13.1 |

OTHER PUBLICATIONS

WIPO, International Search Report for PCT/ES2006/000386.

* cited by examiner

*Primary Examiner*—Victor MacArthur
(74) *Attorney, Agent, or Firm*—Intellectual Property Law Group LLP; Juneko Jackson; Otto O. Lee

(57) ABSTRACT

The invention relates to a continuous metal system which is used to protect motorcyclists and which can be installed on a standard metal safety barrier. The invention comprises a continuous horizontal metal panel (4) which is disposed between the fence (1) and the ground (40). According to the invention, the panel (4) is suspended from the fence (1) by means of arms or support pieces (5) which are positioned at each post (2) and arms which are positioned at the centre of each bay (6) and which are solidly connected to clamps (7). In addition, both arms (5 and 6) are fixed to the fence (1) using the same screw (8).

18 Claims, 10 Drawing Sheets

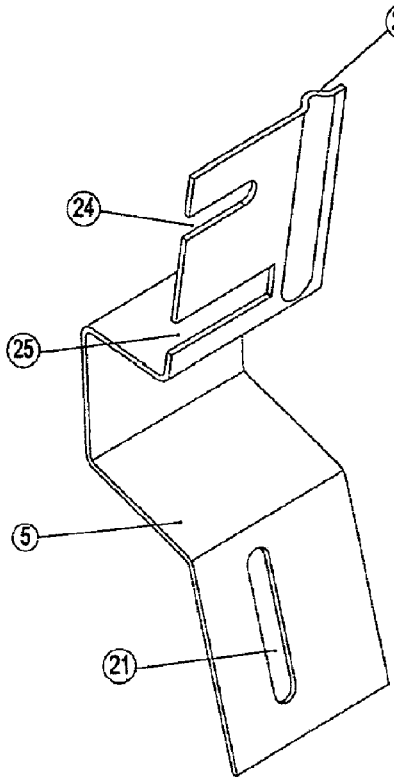
FIG.7a
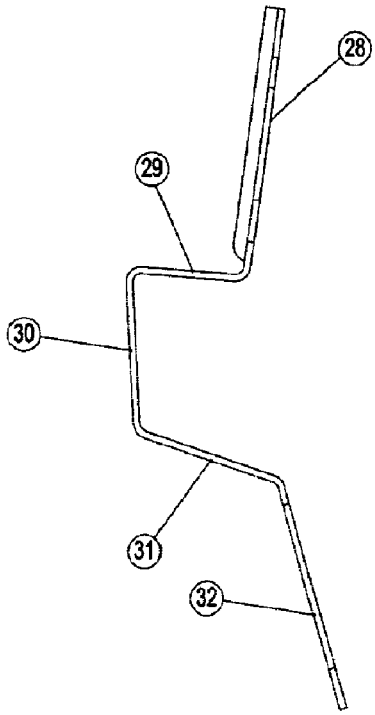
FIG.7b
FIG.7

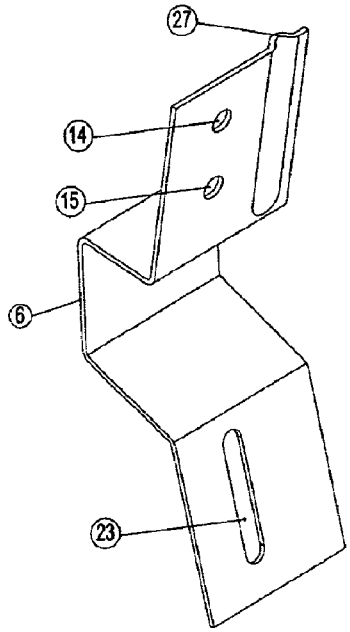
FIG.8a
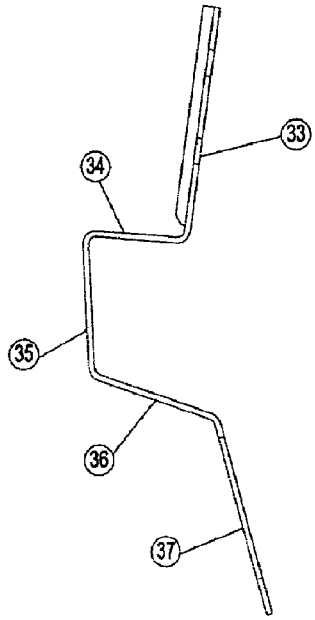
FIG.8b
FIG.8

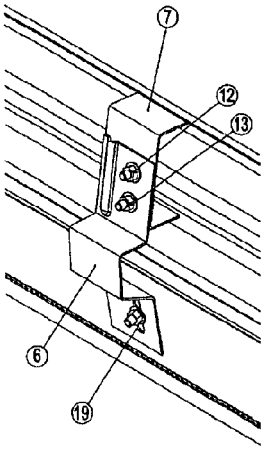
FIG.13a
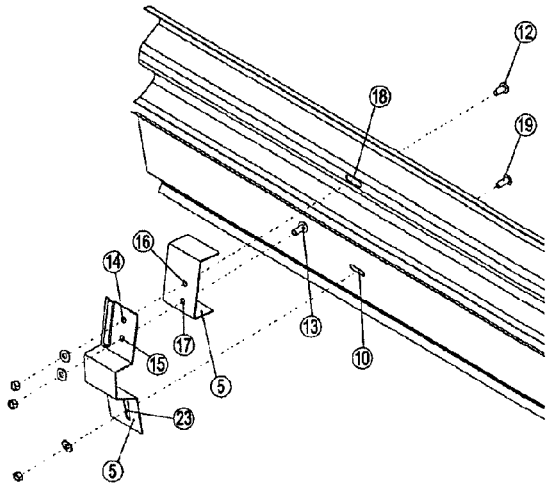
FIG.13b
FIG.13
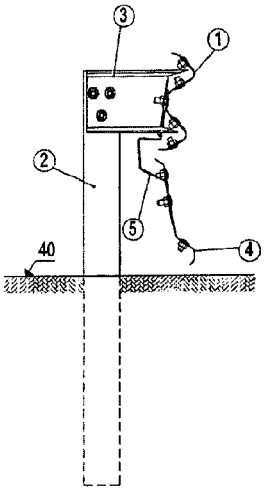
FIG.14a
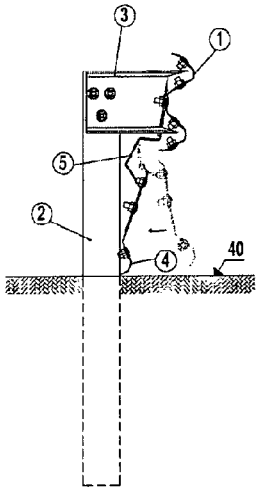
FIG.14b
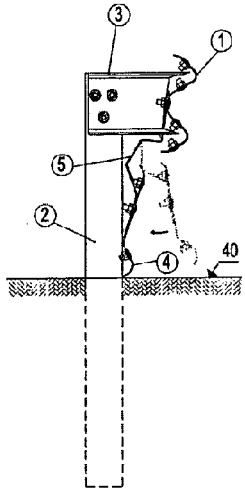
FIG.14c
FIG.14

CONTINUOUS METALLIC SYSTEM FOR SAFETY BARRIERS APPLICABLE AS PROTECTION FOR MOTORCYCLISTS MADE UP OF A BOTTOM CONTINUOUS HORIZONTAL METALLIC SCREEN SUPPORTED ON THE BARRIER BY MEANS OF METALLIC ARMS ARRANGED AT REGULAR INTERVALS

CROSS-REFERENCE TO RELATED APPLICATIONS

This application is a U.S. National Phase application, under 35 U.S.C. §371, of International Application no. PCT/ES2006/000386, with an international filing date of Jul. 5, 2006, and which claims priority to Spanish Patent Application no. U200501560, filed on Jul. 6, 2005, both of which are hereby incorporated by reference in their entireties for all purposes.

BACKGROUND OF THE INVENTION

1. Field of the Invention

This invention is applicable within the industry dedicated to the manufacturing of systems, apparatii, devices and auxiliary elements applied as components for road safety equipments incorporated on roads and similar locations.

2. Background Art

Metallic safety barriers.—Various types of vehicle detention systems exist in the Art, understanding by such, to mean all devices installed on a road with the purpose of providing detention and redirection of a vehicle which leaves the road whilst out of control, thus reducing the severity of produced accidents, in such away, that it restricts the damages and injuries both of their occupants and of the rest of the road users and of other persons or objects located in the neighbourhood.

The most common detention system in our roads and motorways are metallic safety barriers, used at road sides and circulation-lane division rails. The purpose of safety barriers is to resist vehicle impacts, preventing vehicles from crossing through them and thus guaranteeing protection to third parties and in turn, producing a controlled redirecting and deceleration in such a way that the vehicle comes out stably from the impact and continues forward at reduced speed alongside the detention system in the original direction of the traffic, thus guaranteeing the safety of the vehicle occupants and that of other road users According to the applicable standardization system in existence (EN 1317-2 in Europe and NCHRP 350 in the U.S.), safety barriers are subjected, prior to commercial use, to standardized real scale impact tests in which impacts, between a type vehicle and a detention system are carried out under control, thus facilitating a qualitative and quantitative evaluation of its behaviour. A detention system is considered to meet satisfactorily a real scale impact test when the acceptance requirements and criteria defined in the standard as regards detention level, impact severity, deformation and exit angle are met, and in consequence, assures appropriate safety conditions, mainly to the impacted vehicle occupants and to third parties. It is therefore guaranteed that a detention system is capable of retaining a specific type vehicle.

According to said standards, a high detention system (specifically designed to receive heavy vehicle impact, such as lorries and coaches) shall meet real scale impact tests, both of heavy vehicles (lorries and coaches) or heavy tourisms or of light vehicles (light tourisms). This allows the detention systems to additionally assure the safety of light vehicles, which constitute the most frequent type of accidents. For example, according to European Standard EN 1317-2, the N2 level of detention requires compliance with test TB32 (1.500 Kg car weight impact, at a speed of 110 Km/hr, and an approximation angle against the detention system of 20°.) plus test TB11 (900 Kg car weight impact at a speed of 100 Km/hr, and with an approximation angle against the detention system of 20°.).

All elements which constitute the safety barriers are generally capable of reacting similarly and together by means of deformation, versus the impact both of a light and a heavy vehicle.

Metallic safety barriers correspond to the union of three basic metallic elements:

1st.—Fences or railings, longitudinal elements horizontally arranged at one or various levels at specific height and in a continuous manner, the function of which is that of retaining and guiding impacting vehicles, preventing them from penetrating across, restricting the transversal deformation and guiding them in such a manner, that they can be redirected appropriately by the system. The railing may present different configurations: one or various longitudinal profiles with open or almost closed cross section, with double or triple wave or in "C" or "sigma" shape, joined to the post by means of a separating element; tensed metallic cables or rods attached directly to the post; longitudinal profiles in the shape of double or triple wave joined at their bottom part to metallic sheets capable of free movement and calibrated to present a certain resistance versus impact.

2nd.—The Post, vertically arranged at regular intervals and attached to the fence (fences) or rail (railings), the function of which is to support and keep the fence (fences) or rail (railings) of the barrier at a specific height during impact. The posts are generally metallic profiles with "C", "U", "I", "Sigma" or "Z" cross sections, round or rectangular tubular cross sections or other types of cross sections, that are inserted in an embankment or centre circulation-lane division railing in such a way, that part of its length is embedded in the ground or else through a plate with anchorage bolts inserted in the ground. Faced with the impact of a vehicle and based on the energy of said impact, the post deforms in a greater or lesser degree, bending and/or twisting as regards the embedding or anchorage section.

3rd.—The separating element is an intermediate connection part between a fence or railing and the post, the function of which is as follows:

(I) To join, at a set height, the fence or railing to the attachment post, (II) to act as spacing element between said fence or railing and the post so as to prevent the entanglement of the vehicle wheel to the post during impact against the bather and (III) to maintain the fence or railing height as the post deforms by flexure, in such a manner that contact with the vehicle is produced without the appearance of a difference in height of its centre of gravity as regards the railing, which may create a certain tendency of the vehicle to overturn.

Specific types of separators, especially non-stiff separators used in high detention stiff metallic bathers, comply with an additional function, that of (IV) attenuating or absorbing part of the impact energy and contributing to the redirecting of the vehicle during impact. In this latter case, the separator receives the name of energy absorber. The absorbing function of the separator is characteristic of high detention bathers since said barriers present a very robust or stiff basic structure made up of the rail or rails and robust posts arranged at a short distance, capable of retaining heavy vehicles, and because of this, said structure is too stiff for the impact of light vehicles. The separator-absorber is specifically designed to reduce the impact severity of light vehicles against these rigid basic structures, tempering the contact with the post and aiding the redirecting of the vehicle. On some occasions, this element consists of a single item or else of an assembly mounted as from flat bars and/or metallic profiles formed in a more or less complex manner, or in square or rectangular open or closed, cross sectional tubular profiles.

On some occasions, bathers with no separating elements are to be found, the railings being directly attached to the post.

The problem of motorcyclists with metallic safety bathers. In the majority of cases, metallic safety bathers are designed and tested to retain only the impact of vehicles with four or more wheels but in general, they do not take into account the safety of more vulnerable road users, such as motorcyclists and cyclists.

The most common and serious collision of a motorcyclist against a safety barrier is that produced by the loss of verticality of the motorcycle, fall of the motorcyclist, the divergent path of the motorcycle and motorcyclist with sliding of the motorcyclist over the pavement and impact of the motorcyclist's body against the safety barrier, or his penetrating across through the same, and impacting against infrastructural obstacles placed behind the same. The fatal consequences and very sever injuries produced in this type of accidents are in the majority of cases due to injuries in the head and neck of the motorcyclist.

Spanish Standard UNE 135 900 stipulates the test procedures and acceptance criteria for devices installed on metallic barriers for the protection of motorcyclists or else for barriers designed to assure the safety of motorcyclists, which evaluates the body impact behaviour of a motorcyclist who collisions against the system at a set speed and slides over the pavement surface. The test procedure consists in a collision at real scale, with an instrumented dummy—launched against the system at 60 km/hr and at a 30° incidence angle. The efficiency and acceptance criteria parameters related to the severity of impact on the motorcyclist's body is materialized by means of various biomechanical and bio-accurate Indexes measured on the head (accelerations) and on the neck (forces and moments) of the dummies.

In said real scale collision tests with dummies simulating the body of motorcyclists, the dummies are launched against the barrier sliding over the pavement face upwards, at floor level, totally extended with arms parallel to the trunk of their body and headfirst. Impacts on the area of the post are carried out as well as in the centre of the space or middle point of the longitudinal space between two consecutive posts. The vertebral axis of the dummy is parallel to the impact direction, forming 30° as regards the longitudinal alignment of the safety barrier. Consequently, the primary impact (which is the most sever) is produced on the dummy's head (provided with a protection helmet), in such a manner, that the most important and harmful effects on the same are:

(i) the "jerk" of the head that is evaluated by means of the so called HIC index, which is a magnitude proportional to the accelerations experienced by the centre of the dummy's head, and (ii) the stresses on the neck, including all the forces and moments. The neck is very vulnerable in this type of impacts, mainly due to the compression forces in the vertebral axis direction of the dummy, which in Spanish Standard UNE 135 900 is identified as $F_z$.

When a safety barrier, including a protection system for motorcyclists, or else a safety barrier that is specifically designed for the safety of these users, satisfactorily passes the Standard UNE 135 900 tests, complying with all the acceptance criteria, it is considered that safety versus the impact of motorcyclists and cyclists is guaranteed.

According to establishments in Spanish Standard UNE 135 900, all safety bathers that include a protection system for motorcyclists or else all safety bathers specifically designed for the safety of these users, shall additionally assure its behaviour versus impact of two or more wheeled vehicles according to European Standard EN 1317-2.

Protection systems for motorcyclists in safety metallic barriers currently in existence. Two types of devices for motorcyclists protection in metallic safety barriers have been traditionally in use: screen or horizontal continuous profile, and on the other 1. Impact absorbers. These are devices punctually installed around the barrier posts as a covering to reduce the severity of the impact on the motorcyclist against the post. Its efficiency is quite reduced (does not exceed 30 Km/hr) and does not prevent the passing of the motorcyclist beneath the railing, penetrating across the barrier.
2. Continuous systems. These are devices installed in a continuous manner in longitudinal direction to the bather, that function by detaining and redirecting the body of the motorcyclist during impact, preventing both direct impact against the post and penetration across the bather, impacting against the obstacle or drop in the terrain that is being protected by the bather. The continuous systems also operate as punctual systems and are in general, more efficient than previous ones.

Continuous systems are generally made up of a horizontal continuous member intended to retain the impact of the motorcyclist and are always situated below the railing (though sometimes they project upwards superimposed on the bather over the railing) covering the vertical space between the same and the level of the terrain and are attached to the barrier, either through supporting parts arranged at regular intervals and connected to the bather, either on the post, on the railing or on the separator or else are attached to the horizontal continuous member directly to the post or to the safety barrier railing.

This continuous horizontal member is generally a metallic profile, a plastic profile, various parallel metallic or plastic profiles, one or various plastic tubes, a plastic continuous horizontal girder embedding the posts or else a simple plastic mesh placed between the posts. The horizontal member may be a metallic girder with different profile (Type A double wave railing profile, type B double wave railing profile, flat trapezoidal profile . . . ). When the profile, either metallic or of any other material, considered according to its placement position on the barrier, presents reduced width in relation to its height (e.g. in a minor ratio of 100:370) and a good part of the profile is flat or of reduced relief, the profile receives the name of screen.

The more generally used systems are the metallic, double wave profile type and trapezoidal screens (the surface of which is mainly flat with corresponding flanges forming angles below 90° at their ends, said flanges capable of being rounded).

The continuity of the horizontal element, made up of finite length profiles is generally achieved by means of partial overlapping of the adjacent profiles and screwed joints on said overlaps.

The support parts of the screens or profiles present various configurations, and in general receive the name of arms. They are normally metallic and attached by means of screwed joints, on one side, to the side, either directly to the separator, with the joint screw between the railing and the separator, or else directly to the railing or post.

The support parts or arms are generally attached both to the motorcyclist impact detention horizontal element and to the safety barrier by means of screwed joints.

In real scale impact tests with the previously described dummies, with continuous metallic systems of the ones constituted by a bottom horizontal continuous metallic profile and support metallic arms arranged at regular intervals, the collision of the dummy is produced against the bottom continuous horizontal element which is the one that maintains contact with the dummy throughout all the impact, guiding it during the reductive phenomenon and until it separates from the system.

The support parts of the horizontal profile or arms are capable of deforming, rotating and bending towards the front part of the barrier post (the one opposite the side of the traffic), thus providing the system with sufficient capacity of transversal deformation absorbing the impact under control conditions and redirecting the dummy's body. The transversal deformation is restricted by the distance between the rear part of the arm and the front part of the post, until contact of the arm situated facing the post, is produced with said post. FIG. 14 shows successive stages of this type of behaviour in the continuous metallic system that is the object of the present description.

Main problems that remain unsolved in the continuous metallic systems in existence, constituted by a bottom continuous horizontal profile and support arms at regular intervals. Within the continuous systems, the behaviour of which is in general superior to that of impact absorbers, the most frequent and most effective are the metallic systems constituted by a continuous horizontal profile or element placed below the railing of the safety bather, covering the vertical space between its bottom end and the terrain, due to their excellent benefit/cost ratio.

However, according to the efficiency parameters established in Spanish Standard UNE 135 900 to evaluate the behaviour of the protection systems for motorcyclists in metallic safety barriers, defined as from biomechanical indexes that accurately reproduce the predictable damages in the bodies of motorcyclists, the previously indicated continuous metallic systems pose the following problems:

(i) Possibility of freeway through the system in impacts in the centre of the space. When the distance between consecutive posts of the safety barrier exceeds 2 m, the deformation of the screen during an impact in the centre of the space is enormous, causing bagging of the motorcyclist's body, who, by either raising the screen or profile and/or bending it, can totally or partially cross through the screen or profile, with the subsequent probable risk of impact against the post, the cutting of the actual screen or profile and of collision with the infrastructural dangers the barrier is protecting, which are situated behind the same.

(ii) Entanglement of an extremity below the screen. Due to the fact that a free gap, however small, always remains between the screen or profile and the level of the terrain, and that during the tests (and also in real life), the arm of the dummy/motorcyclist is extended parallel to the body, both his hand and his wrist may become entangled between the bottom edge and the screen or profile and the terrain.

(iii) High vertical compression value of the neck. Since in existing systems, the bottom continuous metallic profiles and screens are vertically arranged, during impact, the first contact of the head with the screen or profile is produced at a vertical plane and with this, very high values are reached in the compression force of the neck $F_z$ in direction to the vertebral axis of the dummy's body (that coincides with the impact trajectory) which originates due to the reaction of the profile or screen on the head of the dummy, often over the maximums tolerated by the human body.

BRIEF SUMMARY OF THE INVENTION

The present invention refers to a continuous metallic system for metallic safety barriers, constituted by a continuous horizontal girder placed below the fence or railing of the barrier and attached to the same by means of supporting parts arranged at regular intervals which prevent the body of a motorcyclist, who slides over the road surface, both from impacting directly or indirectly against the support post of the metallic barrier and from crossing through the metallic barrier and passing below the fence or railing, without the installation of said system in the metallic barrier negatively affecting its behaviour versus four wheeled vehicle impact.

BRIEF DESCRIPTION OF THE SEVERAL VIEWS OF THE DRAWINGS

As complement to the description offered, and with the object of aiding to a better understanding of the characteristics of the invention, the present descriptive specification is enclosed with thirteen sheets of drawings forming integral part of the same, in which, with illustrative and non limitative character, the following has been represented;

FIG. 7. Represents a perspective view of the Support Arm (7*a*) and a view of the profile of Support Arm (7*b*)

FIG. 8. Represents a perspective view of Intermediate Arm (8*a*) and a view of the profile of Intermediate Arm (8*b*).

FIG. 13. Represents a back or rear view of the metallic barrier in perspective with the assembled components (13*a*) and exploded components (13*b*), of the zone corresponding to the centre of the space or middle point of the barrier between two consecutive posts.

FIG. 14. Represents the behavioural sequence (14*a*, 14*b* and 14*c*) of the metallic safety barrier with the continuous metallic system for protection of motorcyclists, during impact of the body of a motorcyclist against the screen.

DETAILED DESCRIPTION OF THE INVENTION

Figure 1:
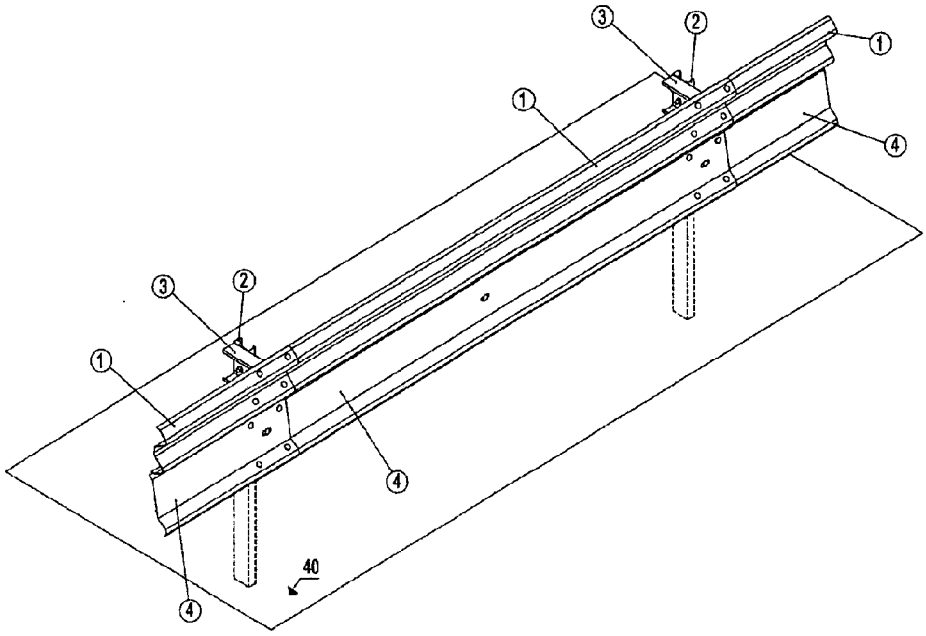
FIG. 1. Corresponds to a front perspective view of a metallic safety barrier for roads with the continuous metallic system.
Figure 2:
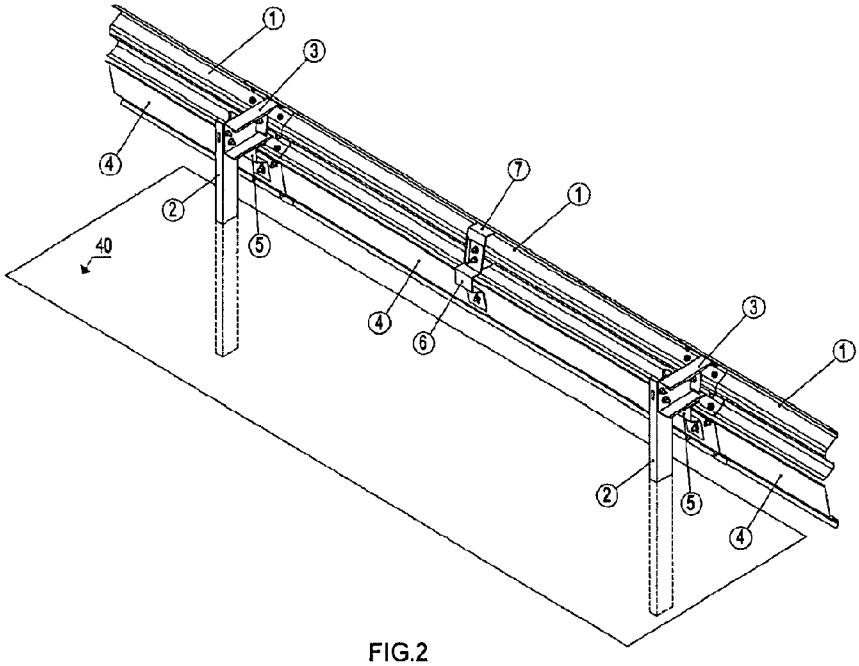
FIG. 2. Corresponds to a rear perspective view of a metallic safety barrier for roads with the continuous metallic system.
Figure 3:
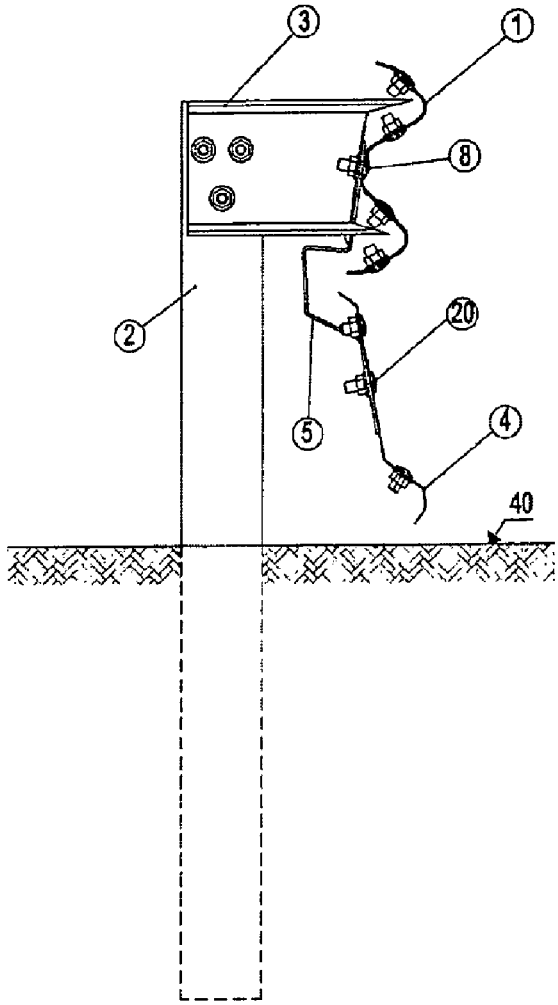
FIG. 3. Represents a straight section of the safety barrier with the continuous metallic system corresponding to the position of a post.
Figure 4:
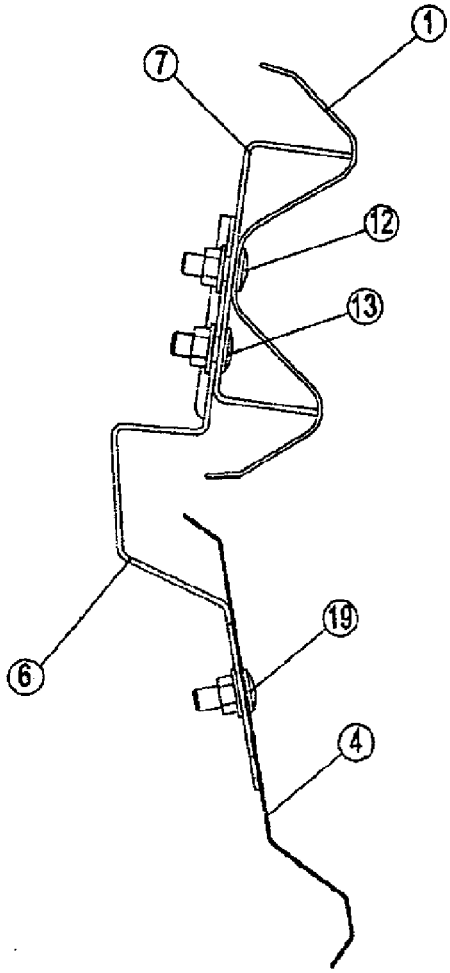
FIG. 4. Represents a straight section of the safety barrier with the continuous metallic system corresponding to the intermediate position between two consecutive posts or space centre.
Figure 5:
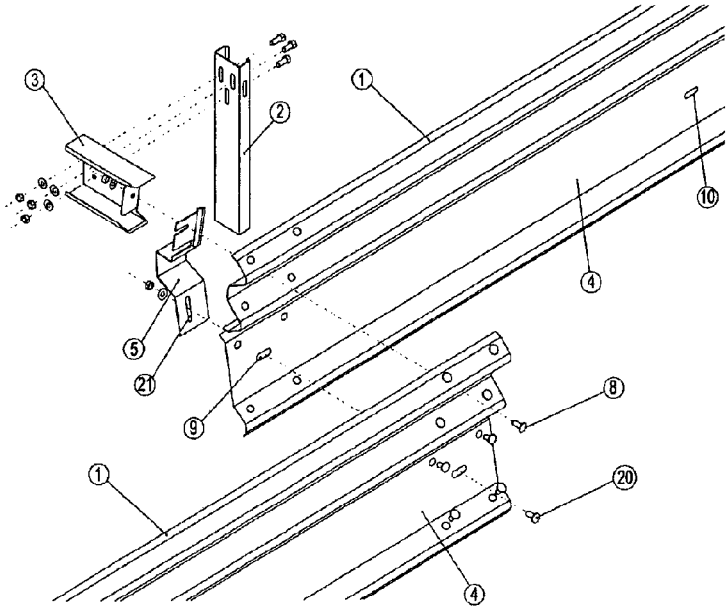
FIG. 5. Represents a front perspective view with an exploded view of the components of the safety barrier with the continuous metallic system, in the zone corresponding to the post FIG. 6. Represents a front perspective view of a section of the screen.
Figure 6:
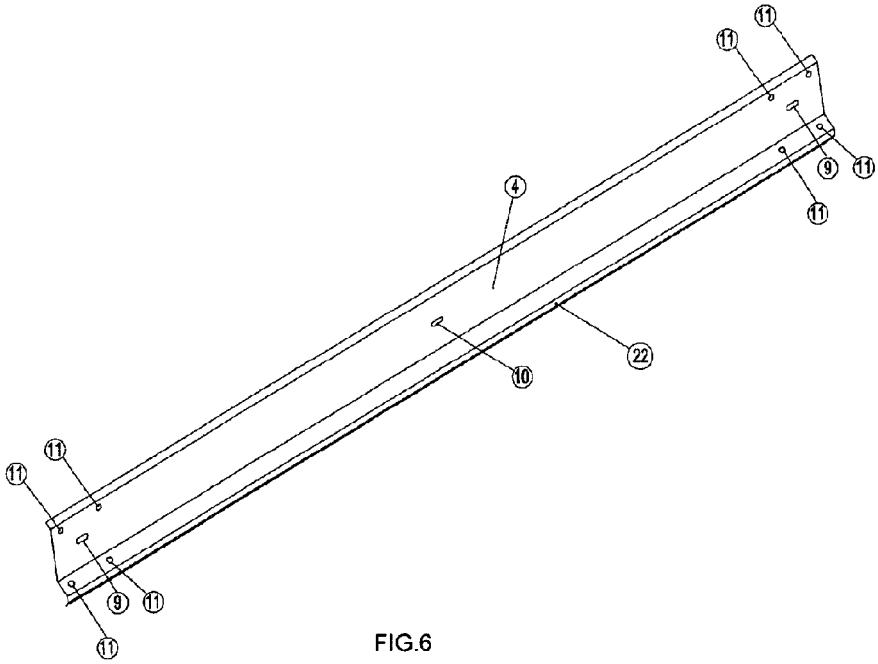
Figure 9:
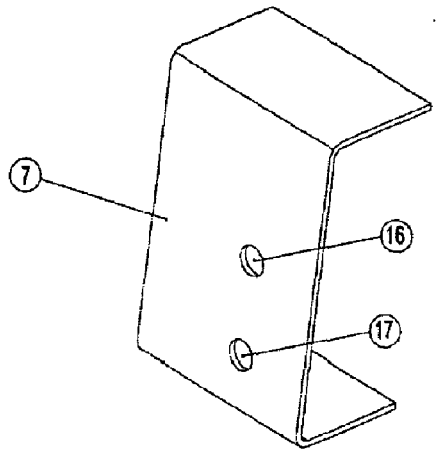
FIG. 9. Represents a perspective view of the "U" shaped Intermediate Clamp.
Figure 10:
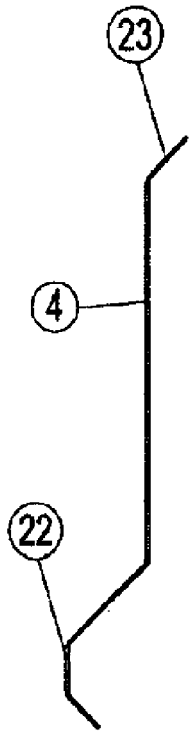
FIG. 10. Represents a straight cross section profile of the screen.
Figure 11:
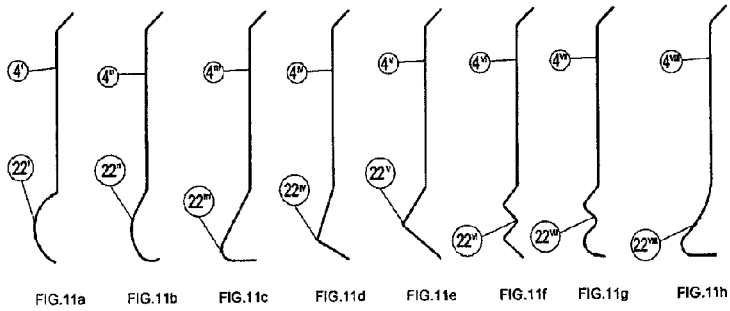
FIG. 11. Corresponds to various variants (11*a*, 11*b*, 11*c*, 11*d*, 11*e*, 11*f*, 11*g* and 11*h*) of the screen profile for various geometries of the bottom protuberance or "nose".
Figure 12:
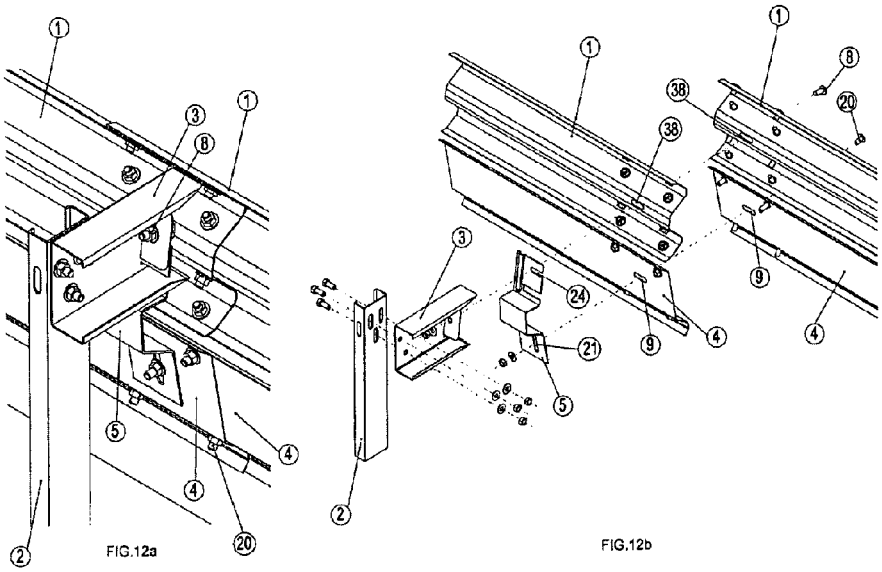
FIG. 12. Represents a back or rear perspective view of the barrier with assembled components (12*a*) and exploded components (12*b*), of the zone corresponding to the post.

The present invention refers to a continuous metallic system for protection of motorcyclists, mountable on a conventional safety metallic barrier, comprised of a continuous horizontal metallic screen (4) arranged below the railing (1) of the metallic barrier, mainly covering the vertical space between the bottom edge of the railing (1) and the level of the terrain (40) the screen (4) being suspended from railing (1) by means of support parts or arms (5) situated opposite post (2) and situated in the centre of the space (6) forming integral part with clamps (7), both arms (5) and (6) being attached to railing (1) in the same joint screw (8) of the same with separator (3), and respectively at an its intermediate point (12). Screen (4) is of flat-trapezoidal profile with a protuberance (22) in the shape of "nose" directed towards the side of the traffic and situated at the bottom edge of the screen.

The metallic screen (4) is a flat-trapezoidal profile that presents a flat central face occupying the greater part of the screen height and with a protuberance (22) at the bottom end of the screen which is directed towards the front part of the barrier or side of the traffic, whilst the upper end of the screen preferably presents a flange directed towards the rear side of the barrier, forming a certain angle with the flat face of the profile or it can present a similar protuberance to the one at the bottom end (22).

Protuberance (22) of screen (4) presents a preferably trapezoidal profile or in the shape of an edge (22) though it can also present similar shapes or profiles that also function as projecting elements, either with rounded, circular shape or levelled such as protuberances ($\mathbf{22}^{I}$) and ($\mathbf{22}^{II}$) of screen ($\mathbf{4}^{I}$) and (4.*sup.*$^{II}$) respectively, either straight triangular shapes with the bottom side appreciable horizontal ($\mathbf{22}^{III}$) or else an isosceles triangle such as protuberances ($\mathbf{22}^{IV}$) and ($\mathbf{22}^{V}$) of screens ($\mathbf{4}^{IV}$), ($\mathbf{4}^{IV}$) and ($\mathbf{4}^{V}$), respectively, or else in double wave corrugated shape, triangular or rounded such as protuberances ($\mathbf{22}^{VI}$) and ($\mathbf{22}^{VII}$) of screens ($\mathbf{4}^{VI}$) and on, respectively, or else in the shape of a projection ($\mathbf{22}^{VIII}$) in the shape of Nose with a concave, rounded sloped side towards the front side or traffic side and a convex horizontal side towards the rear side as in screen ($\mathbf{22}^{VIII}$).

Screen (4) is placed on the safety barrier in such a manner, that its flat face forms a certain angle (though never over 15°) with the vertical, in counter-clockwise turning direction, in such a way, that the bottom part of screen (4) is placed nearest the traffic, that is to say, in such a way, that the bottom protuberance (22) is presented as advanced part according to the impact direction.

The horizontal continuity between screens (4) is achieved by means of partial overlapping between every two consecutive screens at their ends and screwed joints, obtained by means of multiple screw+washer+nut assemblies that successively penetrate corresponding holes (11), two by two, at each end of each screen (4) in the overlapping.

Metallic arms (5) and (6) of the system assembled on safety barriers, applicable as protection for motorcyclists, that are the object of this description, are constituted by a metallic flat bar of constant width, configurated in the shape of a vertical, laid-down "omega", that attaches screen (4) to railing (1), the screen (4) being kept suspended as regards railing (1).

The arm constitutes the intermediate connection element between the metallic barrier, specifically railing (1), and screen (4) and additionally, provides the mechanism for the deformation in case of impact of a motorcyclist against screen (4).

The system that is the object of the present description includes two types of arms:

(i) Support Arm (5). This is the support part that connects screen (4) with railing (1) exactly on its joint screw (8) with separator (3) and consequently, the position of this arm (5) always corresponds with the position of a post (2) and separator (3).

(ii) Intermediate Arm (6). This is the support part that attaches screen (4) directly with railing (1) at the centre (preferably at the middle point) of the space (1) or longitudinal space between two consecutive posts. The position of the Intermediate Arm does not correspond with any post (2) or separator (3), being on the contrary, arranged at an intermediate section between consecutive posts.

Intermediate Arm (6) is preferably joined by means of screws (12) and (13), to a metallic clamp or Intermediate Clamp (7), with "U" shape (the wings or flanks of which preferably form straight angles with the web though they can also be a trapezoidal "U" shape with the wings forming a certain angle over 90° with the web), these wings or flanks presenting an equal or slightly longer length than the distance between the top face of Intermediate Arm (6) and railing (1) in such a way, that both wings of the Intermediate Clamp (7) frontally abut by their ends against the internal inside of the railing (1) profile crests, exerting a sufficient degree of pressure so that the Intermediate Arm (6) remains blocked or "locked" against the internal or rear part of railing (1) thus preventing the possible rotation of Intermediate Arm (6) according to a horizontal axis perpendicular to railing (1) around the union point (12) of the same (6) with the actual railing (1).

Support Arm (5) presents five faces, successively from top to bottom, referenced with (28), (29), (30), (31) y (32) and four horizontal hinge folds between consecutive faces.

Top face (28) is slightly sloped towards the side of the traffic and it is the one that keeps contact with railing (1) and separator (3). Face (29) forms an approximately straight angle with the top adjacent face (28) and is sloped upwards so that the second fold between faces (29) and (30) never abuts on the bottom wing of separator (3) once the device is placed on the metallic barrier. Face (30) is appreciably vertical, so that the fold between face (30) and (31) does not contact the front face of the post (2) once the device is placed on the metallic barrier. Face (31) is sloped downwards and the bottom face (32) is slightly sloped as regards the vertical so that the bottom edge of this face (32) that coincides with the bottom edge of Support Arm (5) is directed as advance towards said side of the traffic or front of the barrier. Bottom face (32) is the face of Support Arm (5) that keeps contact with the screen (4).

Support Arm (5) is attached to the metallic barrier, just on the actual joint (8) between railing (1) and separator (3), that corresponds with the centre of the joint between consecutive railings by means of overlapping, by means of the actual screw (8) that, after penetrating the central horizontal elongated hole (38) of railings (1) in the joint between them by means of overlapping, penetrates an elongated hole (24) horizontally arranged on the top face (28) of the Support Arm (5) carried out for that purpose.

The object of the connection of Support Arm (5) with the barrier in joint (8) in existence between railing (1) and separator (3) is to prevent that the placement of the invention affects the behaviour of the metallic barrier versus the impact of four wheeled vehicles, in turn appreciably aiding the placing operation since it only and exclusively requires the loosening of a screw to insert the top face of the arm between the railing and the separator, thus preventing the need of dismounting, that is to say, of proceeding to the disassembly of the metallic barrier.

The Support Arm (5) is provided with a horizontal elongated hole (25) at its top face (28) placed below the attachment hole (24) also horizontal, the object of the which is to leave free the passage of the bottom wing of separator (3), thus preventing the interference between the same and the Support Arm.

The Support Arm (5) is provided, on its top face (28) with a vertical rib (26) or vertical grooved surface that extends from the top edge or borders up to the proximities of the fold between the top face (28) and the consecutive one (29) and presents a preferred and appreciably semicircular section, though it can also be triangular or trapezoidal. The vertical rib (26) is situated very near the vertical edge of the top face (28) of the side opposite to the apertures of the horizontal elongated holes (24) and (25). The object of the vertical rib (26) is to stiffen the top face (28) of the Support Arm (5) at the zone comprised between the bottom horizontal hole (25) and the edge, thus preventing that the Support Arm (5) bends at this zone during impact.

The bottom face (32) of the Support Arm (5) presents a vertical elongated hole (21), not necessarily centred on the face, that permits the union between the Support Arm (5) and screen (4) by means of a screw+washer+nut assembly (20) that successively penetrates the central horizontal elongated hole (9) of each one of the two consecutive screens (4) at the overlap between both and the vertical elongated hole (21) of Support Arm (5). The central horizontal elongated hole (9) of the screens (4) on the overlap permits the adjustment of the horizontal position of the screens (4) in relation to post (2) and the actual Support Arm (5) and the vertical elongated hole (21) of Support Arm (5) permits the adjustment of the vertical position of screens (4) in relation to the railing (1) and at the level of the terrain (40).

Intermediate Arm (6) presents five faces, successively from top to bottom, referenced with (33), (34), (35), (36) and (37) and four horizontal hinge folds between consecutive faces. The Intermediate Arm (6) profile is appreciably the same, or equal to that of Support Arm (5).

Top face (33) is slightly sloped towards the side of the traffic and it is the one that keeps contact with railing (1). Face (34) forms an approximately straight angle with the top adjacent face (33) and is sloped upwards. Face (35) is appreciably vertical. Face (36) is sloped downwards and the bottom face (37) is slightly sloped as regards the vertical in such a manner, that the bottom edge of this face (37) that coincides with the bottom edge of Intermediate Arm (6) is directed as advance towards the side of the traffic or front of the barrier. Bottom face (37) is the Intermediate Arm (6) this face maintaining contact with the screen (4).

Intermediate Arm (6) is joined to the railing (1) by means of a screw+washer+nut assembly (12) that successively penetrates the horizontal elongated hole (18) at the centre of the straight section of railing (1) in a section of the intermediate barrier between two consecutive posts, a hole (16), preferably round, of the Intermediate Clamp (7) and a hole (14), preferably round, of Intermediate Arm (6). In addition to the previous screw (12), Intermediate Clamp (7) is attached to Intermediate Arm (6), by means of a screw+nut+washer assembly (13) that successively penetrates a hole (17), preferably round, of Intermediate Clamp (7) and a preferably round hole (15) of Intermediate Arm (6).

Holes (14) and (15) of the top Intermediate Arm (6) face are preferably aligned on the same vertical plane and their relative position corresponds with the position of holes (16) and (17) of Intermediate Clamp (7) in such a way that the possibility of rotation of apart (6) as regards the other (7) is cancelled once joints (12) and (13) have been tightened, and thanks to the pressure exerted by the end of the Intermediate Clamp (7) wings against the centre of the double wave profile of railing (1), it prevents the rotation of both parts (6) and (7) as regards the railing (1), which faced with the impact of a motorcyclist, behaves as a stiff and fixed element.

Intermediate Arm (6) is provided on its top face (33) with a vertical rib (27) that extends from the edge or top border up to the proximities of the folds between the top face (33) and the consecutive one (34) and presents a preferred, appreciably semicircular section, though it can also be triangular or trapezoidal. The vertical rib (27) is situated very near the vertical edge of the top face (33) of the side opposite that of the rounded holes (14) and (15). The object of vertical rib (27) is to stiffen top face (33) of the Intermediate Arm (6).

Bottom face (37) of Intermediate Arm (6) presents a vertical elongated hole (23), not necessarily centred on the face, that permits the union between Intermediate Arm (6) and screen (4) by means of a screw+washer+nut assembly (19) that successively penetrates the central horizontal elongated hole (10) situated on the central or middle section of screen (4) and the vertical elongated hole (23) of Intermediate Arm (6). Central horizontal elongated hole (10) of the middle section of screen (4) permits the adjustment of the horizontal position of screen (4) in relation to the vertical position of consecutive posts (2) and the actual Intermediate Arm (6) and vertical elongated hole (23) of Intermediate Arm (6) permits the adjustment of the vertical position of screen (4) in relation to railing (1) and the terrain (40) level.

The present invention presents four innovations as solution to the three main problems of the continuous metallic systems in existence up to the present moment and which are described in the Background Art:

(i) Incorporation of an Intermediate Arm (6) in the centre of the space that includes an Intermediate Clamp (7) to prevent the rotation of the Intermediate Arm according to an axis perpendicular to its top face and around its union point with railing (1). Intermediate arm restricts the deformation of screen (4) versus impact at the centre of the space and Intermediate Clamp (7) avoids rotation of the intermediate arm which restricts in a final manner, any possibility that the central arrow increases because of this concept. When the Intermediate Arm rotates in this direction and when due to the effect of the impact (in such a way that the joint (19) of said arm (6) with the screen moves in impact direction), a greater deformation is permitted in the longitudinal space comprised between the centre of the space and the following post, aiding the bagging of the dummy in this zone.

(ii) Presence of vertical ribs (16) and (27) on the top face of Support Arms (5) and Intermediate Arm (6), respectively. Vertical ribs (26) and (27) increase the stiffness of Parts (5) and (6) respectively, which contributes to reduce their transversal deformation during the impact of the motorcyclist's body against screen (4) and with this, prevent an excessive transversal deformation of screen assembly (4), and arms (5) and (6) permit the passage of the motorcyclist's body through the barrier, below railing (1), either as a consequence of a partial elevating of screen (4) or of a plastic deformation by local warping of the same.

(iii) The arrangement of a protuberance (22) in the shape of "nose" directed towards the side of the impact and situated just on the lower edge of screen (4) during primary contact with the dummy, produces an upward reaction force in the same, that slightly elevates the upper extremity of the dummy preventing entanglement of the hand and wrist inside the vertical free space existing between the bottom edge of the screen and the terrain.

(iv) The sloped arrangement of screen (4) forming a small angle (below 15°) with the vertical plane, in such a manner that the bottom edge of the same appears in advanced position in direction to the traffic, allowing, during a first contact of the head with the screen, to appreciably reduce the horizontal component of the reaction force of the screen on the dummy's neck, which translates into a compression decrease in the neck according to vertebral axis ($F_z$) up to values that are easily tolerable by the human neck.

FIG. 14 illustrates the successive stages (14*a*, 14*b*, and 14*c*) of the metallic barrier assembly behaviour with the continuous metallic system versus the impact of the body of a motorcyclist that approximates, sliding, knocked down and extended over the pavement and that collides against screen (4) at a certain speed and at a certain angle. Contact between the body of the motorcyclist and the barrier is produced between him and screen (4). Faced with the force transmitted by the motorcyclist to the screen, Support Arm (5)—as occurs to Intermediate Arm (6)—deforms, rotating on a vertical plane successively around the folds between consecutive faces. Initially, the arm rotates around the fold between faces (28) and (29) until the fold between faces (29) and (30) abut against the bottom wing of separator (3). As from then onwards, the arm continues rotating around the fold between faces (29) and (30) until the fold between faces (30) and (31) abut against the front face of the post (2). The arm continues rotating around the fold between faces (31) and (32) until the bottom face of arm (32) abuts directly against the front face of post (2). The full capacity of rotation of the arm is thus completed, passing on from here to the deformation of the actual screen (4).

The invention claimed is:

1. A combined metallic barrier and continuous metallic protection system for motorcyclists, the barrier comprises a metallic railing, a plurality of support posts spaced at regular intervals along the railing and a plurality of separators attaching the railing to each of the support posts, the protection system attached below the barrier and comprising:

a horizontal continuous metallic screen suspended below the metallic barrier by a plurality of metallic support arms connecting the screen with the railing at each support post, and a plurality of intermediate metallic arms connecting the screen with the railing at a position between two consecutive support posts;

each of the plurality of metallic support arms having a top face and a bottom face, the bottom face directly attached to a rear side of the metallic screen, the top face directly attached to a rear side of the railing at a point where the metallic railing attaches to one of the separators;

each of the intermediate metallic arms having a top face and a bottom face, the bottom face directly attached to the rear side of the metallic screen at the position between two consecutive support posts, the top face directly attached to a rear side of a middle face of a metallic U-shaped clamp by two or more screwed joints;

the U-shaped clamp having two wings extending perpendicularly forward from the middle face, such that when attaching a front side of the middle face directly to the rear side of the railing, each wing terminates at a length abutting against a central internal point of the rear of the railing exerting a pressure against the railing;

wherein the assembly of the intermediate metallic arm with the U-shaped clamp onto the railing prevents a rotation of the intermediate metallic arm relative to the U-shaped clamp, and prevents a rotation of both the U-shaped clamp and intermediate metallic arm relative to the railing.

2. The system according to claim 1, wherein the metallic screen has a protuberance at a bottom edge of the screen directed towards a front side of the metallic barrier facing a traffic side, providing a stiffness against deformation of the screen and an upward motion against an object impacting the screen.

3. The system according to claim 2, wherein a side profile of the protuberance is selected from the group consisting of trapezoidal in shape, rounded in shape, triangular in shape, a corrugated rounded wave shape, and a corrugated triangular wave shape.

4. The system according to claim 3, wherein the metallic screen is sloped in a counter-clockwise direction at a small angle, not greater than 15° from a vertical plane towards the front side of the metallic barrier.

5. The system according to claim 4, wherein the top face of each of the metallic support arms and the top face of each of the intermediate metallic arms, each are joined to a respective adjacent face and separated by a fold;

each respective top face having a vertical rib extending from a top horizontal edge of the top face along one side to the fold;

wherein the vertical rib of the metallic support arm is situated on a side of its top face opposite a plurality of elongated apertures; and, wherein the vertical rib of the intermediate support arm is situated on a side of its top face opposite a plurality of rounded holes.

6. The system according to claim 5, wherein a profile of the vertical rib is in a shape selected from the group consisting of a circular arc, elliptical arc, triangular arc, and trapezoidal arc.

7. The system according to claim 3, wherein the top face of each of the metallic support arms and the top face of each of the intermediate metallic arms, each are joined to a respective adjacent face and separated by a fold;

each respective top face having a vertical rib extending from a top horizontal edge of the top face along one side to the fold;

wherein the vertical rib of the metallic support arm is situated on a side of its top face opposite a plurality of elongated apertures; and, wherein the vertical rib of the intermediate support arm is situated on a side of its top face opposite a plurality of rounded holes.

8. The system according to claim 7, wherein a profile of the vertical rib is in a shape selected from the group consisting of a circular arc, elliptical arc, triangular arc, and trapezoidal arc.

9. The system according to claim 2, wherein the metallic screen is sloped in a counter-clockwise direction at a small angle, not greater than 15° from a vertical plane towards the front side of the metallic barrier.

10. The system according to claim 9, wherein the top face of each of the metallic support arms and the top face of each of the intermediate metallic arms, each are joined to a respective adjacent face and separated by a fold;

each respective top face having a vertical rib extending from a top horizontal edge of the top face along one side to the fold;

wherein the vertical rib of the metallic support arm is situated on a side of its top face opposite a plurality of elongated apertures; and, wherein the vertical rib of the intermediate support arm is situated on a side of its top face opposite a plurality of rounded holes.

11. The system according to claim 10, wherein a profile of the vertical rib is in a shape selected from the group consisting of a circular arc, elliptical arc, triangular arc, and trapezoidal arc.

12. The system according to claim 2, wherein the top face of each of the metallic support arms and the top face of each of the intermediate metallic arms, each are joined to a respective adjacent face and separated by a fold;

each respective top face having a vertical rib extending from a top horizontal edge of the top face along one side to the fold;

wherein the vertical rib of the metallic support arm is situated on a side of its top face opposite a plurality of elongated apertures; and, wherein the vertical rib of the intermediate support arm is situated on a side of its top face opposite a plurality of rounded holes.

13. The system according to claim 12, wherein a profile of the vertical rib is in a shape selected from the group consisting of a circular arc, elliptical arc, triangular arc, and trapezoidal arc.

14. The system according to claim 1, wherein the metallic screen is sloped in a counter-clockwise direction at a small angle, not greater than 15° from a vertical plane towards a front side of the metallic barrier.

15. The system according to claim 14, wherein the top face of each of the metallic support arms and the top face of each of the intermediate metallic arms, each are joined to a respective adjacent face and separated by a fold;

each respective top face having a vertical rib extending from a top horizontal edge of the top face along one side to the fold;

wherein the vertical rib of the metallic support arm is situated on a side of its top face opposite a plurality of elongated apertures; and, wherein the vertical rib of the intermediate support arm is situated on a side of its top face opposite a plurality of rounded holes.

16. The system according to claim 15, wherein a profile of the vertical rib is in a shape selected from the group consisting of a circular arc, elliptical arc, triangular arc, and trapezoidal arc.

17. The system according to claim 1, wherein the top face of each of the metallic support arms and the top face of each of the intermediate metallic arms, each are joined to a respective adjacent face and separated by a fold;

each respective top face having a vertical rib extending from a top horizontal edge of the top face along one side to the fold;

wherein the vertical rib of the metallic support arm is situated on a side of its top face opposite a plurality of elongated apertures; and, wherein the vertical rib of the intermediate support arm is situated on a side of its top face opposite a plurality of rounded holes.

18. The system according to claim 17, wherein a profile of the vertical rib is in a shape selected from the group consisting of a circular arc, elliptical arc, triangular arc, and trapezoidal arc.

* * * * *